US009141039B2

(12) United States Patent
Kato et al.

(10) Patent No.: US 9,141,039 B2
(45) Date of Patent: Sep. 22, 2015

(54) IMAGE FORMING APPARATUS INCLUDING A CAM MEMBER TO SEPARATE A TRANSFER MEMBER

(71) Applicants: Yuji Kato, Kanagawa (JP); Ryuuichi Mimbu, Kanagawa (JP); Yasufumi Takahashi, Tokyo (JP); Kenji Sengoku, Kanagawa (JP); Junpei Fujita, Kanagawa (JP); Osamu Ichihashi, Kanagawa (JP)

(72) Inventors: Yuji Kato, Kanagawa (JP); Ryuuichi Mimbu, Kanagawa (JP); Yasufumi Takahashi, Tokyo (JP); Kenji Sengoku, Kanagawa (JP); Junpei Fujita, Kanagawa (JP); Osamu Ichihashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/018,525

(22) Filed: Sep. 5, 2013

(65) Prior Publication Data

US 2014/0072340 A1 Mar. 13, 2014

(30) Foreign Application Priority Data

Sep. 10, 2012 (JP) ..... 2012-198313

(51) Int. Cl.

*G03G 15/08* (2006.01)
*G03G 15/00* (2006.01)
*G03G 15/16* (2006.01)

(52) U.S. Cl.

CPC ..... *G03G 15/1605* (2013.01); *G03G 15/167* (2013.01)

(58) Field of Classification Search

CPC ..... G03G 15/1605; G03G 15/167
USPC ..... 399/121, 388, 389, 302, 308, 376, 66
See application file for complete search history.

(56) References Cited

U.S. PATENT DOCUMENTS

2003/0219287 A1 11/2003 Ogiyama et al.
2006/0056884 A1 3/2006 Sawai et al.
2007/0258737 A1 11/2007 Ogiyama et al.
2008/0124155 A1 5/2008 Mimbu
2008/0232867 A1 9/2008 Minbu et al.

(Continued)

FOREIGN PATENT DOCUMENTS

JP 2011-133653 7/2011

OTHER PUBLICATIONS

U.S. Appl. No. 13/845,780, filed Mar. 18, 2013.

(Continued)

*Primary Examiner* — Billy Lactaoen
(74) *Attorney, Agent, or Firm* — Oblon, McClelland, Maier & Neustadt, L.L.P.

(57) ABSTRACT

An image forming apparatus includes an image forming unit; an intermediate transfer member; a secondary transfer member to form a secondary transfer nip with the intermediate transfer member and the secondary transfer member; a biasing mechanism to bias the secondary transfer member toward the intermediate transfer member; a cam member rotatable between a first position, at which a predetermined space is formed in the secondary transfer nip, and a second position, at which the secondary transfer member and the intermediate transfer member contact each other; and a contact-separation controller configured to put the cam member in the first position before entry of the recording medium into the secondary transfer nip, rotate the cam member toward the second position when the recording medium enters the secondary transfer nip, and change a start timing of rotation of the cam member in accordance with a thickness of the recording medium.

9 Claims, 6 Drawing Sheets

(56) References Cited

U.S. PATENT DOCUMENTS

| | | | | |
|---|---|---|---|---|
| 2009/0060611 | A1 | 3/2009 | Minbu | |
| 2009/0142083 | A1 | 6/2009 | Minbu | |
| 2009/0279927 | A1 | 11/2009 | Fujita | |
| 2010/0061741 | A1 | 3/2010 | Minbu | |
| 2010/0067952 | A1 | 3/2010 | Fujita et al. | |
| 2010/0142985 | A1 | 6/2010 | Minbe et al. | |
| 2010/0221029 | A1* | 9/2010 | Minbu et al. | 399/66 |
| 2010/0272478 | A1 | 10/2010 | Ichihashi | |
| 2010/0310292 | A1* | 12/2010 | Furukawa et al. | 399/381 |
| 2011/0064487 | A1 | 3/2011 | Ichihashi et al. | |
| 2011/0158690 | A1* | 6/2011 | Mimbu et al. | 399/121 |
| 2011/0206399 | A1 | 8/2011 | Fujita et al. | |
| 2011/0286759 | A1 | 11/2011 | Ichihashi et al. | |
| 2011/0293312 | A1 | 12/2011 | Mimbu et al. | |
| 2012/0003017 | A1 | 1/2012 | Minbu | |
| 2012/0121293 | A1* | 5/2012 | Mimbu et al. | 399/121 |
| 2012/0148300 | A1 | 6/2012 | Katoh et al. | |
| 2012/0224879 | A1 | 9/2012 | Fujita et al. | |
| 2012/0237233 | A1 | 9/2012 | Kato et al. | |
| 2012/0237260 | A1 | 9/2012 | Sengoku et al. | |
| 2012/0237271 | A1 | 9/2012 | Sengoku et al. | |
| 2012/0308250 | A1 | 12/2012 | Shimizu et al. | |
| 2012/0315058 | A1 | 12/2012 | Shimizu et al. | |
| 2012/0328315 | A1 | 12/2012 | Takeuchi et al. | |
| 2012/0328320 | A1 | 12/2012 | Fujita et al. | |
| 2012/0328321 | A1 | 12/2012 | Takeuchi et al. | |
| 2013/0004190 | A1 | 1/2013 | Sengoku et al. | |
| 2013/0011155 | A1 | 1/2013 | Ogiyama et al. | |
| 2013/0016989 | A1 | 1/2013 | Fujita et al. | |
| 2013/0089363 | A1 | 4/2013 | Mimbu et al. | |
| 2013/0094870 | A1 | 4/2013 | Shimizu et al. | |
| 2013/0114982 | A1 | 5/2013 | Ichihashi et al. | |
| 2013/0136477 | A1 | 5/2013 | Ogiyama et al. | |

OTHER PUBLICATIONS

U.S. Appl. No. 13/796,167, filed Mar. 12, 2013.
U.S. Appl. No. 13/861,110, filed Apr. 11, 2013.

* cited by examiner

IMAGE FORMING APPARATUS INCLUDING A CAM MEMBER TO SEPARATE A TRANSFER MEMBER

CROSS-REFERENCE TO RELATED APPLICATIONS

This patent application is based on and claims priority pursuant to 35 U.S.C. §119 from Japanese Patent Application No. 2012-198313, filed on Sep. 10, 2012 in the Japan Patent Office, the disclosure of which is hereby incorporated by reference herein in its entirety.

BACKGROUND

1. Technical Field

Exemplary aspects of the present disclosure generally relate to an image forming apparatus including an intermediate transfer member.

2. Related Art

Image forming apparatuses using electrophotography and employing intermediate transfer are well known. In such image forming apparatuses using an intermediate transfer method, for example, multiple toner images are sequentially formed on an image carrier such as a photoreceptor drum. The multiple toner images are then sequentially superimposed on each other in a primary transfer to a rotationally moving intermediate transfer member. A composite toner image formed of the multiple toner images on the intermediate transfer member is transferred in a secondary transfer to a recording sheet such as a transfer paper that is a recording medium.

Image forming apparatuses using the intermediate transfer method have certain advantages, such as being easy to downsize and little restriction on the type of recording medium used. Thus, these image forming apparatuses are frequently used for color image forming apparatus.

There are image forming apparatuses using a type of intermediate transfer method that includes a secondary transfer roller forming a secondary transfer nip with the intermediate transfer member, and a mechanism for contacting and separating the secondary transfer roller to and from the intermediate transfer member.

For example, a related art describes an image forming apparatus including a secondary transfer opposing roller provided opposite the secondary transfer roller to support an intermediate transfer belt serving as the intermediate transfer member from the back, and a cam member provided on the same axis of the secondary transfer opposing roller to contact a follower (a free rotation roller) provided on the same axis of the secondary transfer roller.

In the above-described image forming apparatus, a protruding portion of the cam member contacts the free rotation roller before the recording sheet enters the secondary transfer nip. By the contact of the protruding portion of the cam member to the free rotation roller of the secondary transfer roller, the secondary transfer roller that is pressed toward the intermediate transfer belt is separated from the intermediate transfer belt. As a result, a space is formed in the secondary transfer nip between the secondary transfer roller and the intermediate transfer belt and is maintained. Just before the recording sheet enters the secondary transfer nip, the cam member is rotated to a position at which the protruding portion of the cam member does not contact the free rotation roller of the secondary transfer roller.

As a result, generation of a load change is prevented due to the slight space in the secondary transfer nip when a front end of the recording sheet enters the secondary transfer nip. The space is eliminated immediately after the recording sheet enters the secondary transfer nip. Accordingly, the recording sheet is reliably sandwiched in the secondary transfer nip, and reliable secondary transfer of a toner image is realized. The above configuration is particularly effective in a case in which the recording sheet that is being passed through is relatively thick (hereinafter referred to as thick recording sheet). The generation of load change and vibration due to the impact of the recording sheet striking the intermediate transfer belt and the secondary transfer roller when the front end of the thick recording sheet enters is reduced and hence a good toner image is produced.

However, in conventional image apparatuses with the intermediate transfer method that includes the above-described mechanism, a start timing of the rotation of the cam member in a direction in which the protruding portion of the cam member does not contact the free rotation roller (eliminates the space in the secondary transfer nip) is constant upon the entry of the recording sheet into the secondary transfer nip.

Accordingly, if the cam member starts to rotate to provide an appropriate space for the thick recording sheet upon entry into the secondary transfer nip, the space upon entry into the secondary transfer nip is too large when the recording sheet is relatively thin (hereinafter referred to as thin recording sheet) or is a normal sheet of paper. Thus, when the separation of the secondary transfer roller and the intermediate transfer belt is cancelled, a return shock occurs to both the secondary transfer roller and the intermediate transfer belt. The return shock generates load change and vibration, resulting in image failure.

SUMMARY

In view of the foregoing, in an aspect of this disclosure, there is provided a novel image forming apparatus including an image forming unit to form a toner image on an image carrier, an intermediate transfer member to which the toner image formed on the image carrier is transferred in a primary transfer, and a secondary transfer member to form a secondary transfer nip with the intermediate transfer member and the secondary transfer member. The secondary transfer member transfers the toner image on the intermediate transfer member to a recording medium when the recording medium passes through the secondary transfer nip in a secondary transfer. The image forming apparatus also includes a biasing mechanism to bias the secondary transfer member toward the intermediate transfer member, and a cam member. The cam member is rotatable between a first position, at which the secondary transfer member is separated from the intermediate transfer member to form a predetermined space in the secondary transfer nip, and a second position, at which the secondary transfer member and the intermediate transfer member contact each other. The image forming apparatus also includes a contact-separation controller configured to put the cam member is in the first position to form the predetermined space in the secondary transfer nip before entry of the recording medium into the secondary transfer nip, rotate the cam member toward the second position when the recording medium enters the secondary transfer nip, and change a start timing of rotation of the cam member in accordance with a thickness of the recording medium.

The aforementioned and other aspects, features, and advantages will be more fully apparent from the following detailed description of illustrative embodiments, the accompanying drawings, and the associated claims.

DETAILED DESCRIPTION

Figure 1:
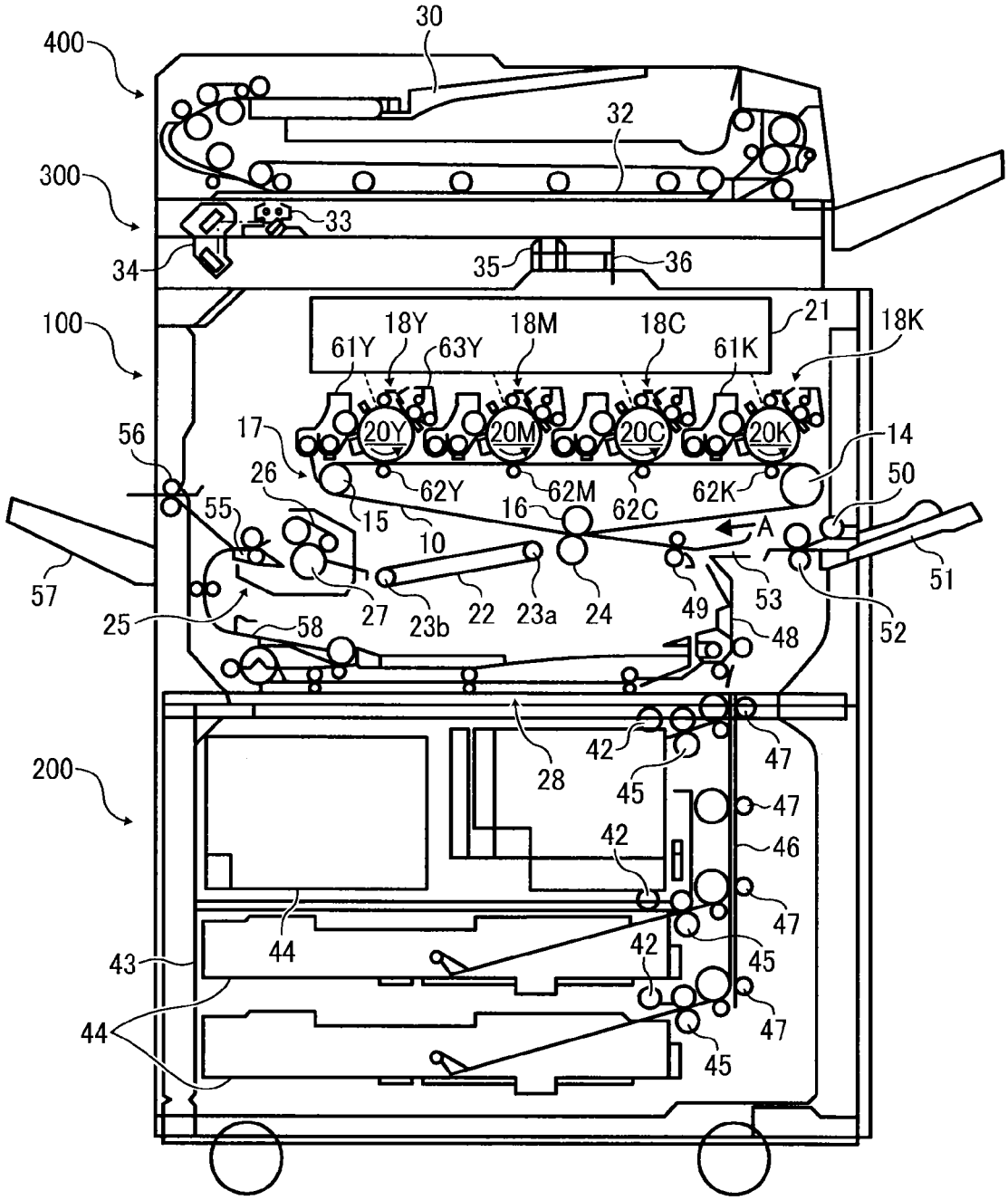
FIG. 1 is a schematic diagram illustrating an overview of a color copy machine as an example of an image forming apparatus according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, although this specification refers to paper, sheets thereof, paper feeder, etc., solely for simplicity, it should be understood that the sheets, etc., are not limited only to paper, but include other printable media as well.

In view of the foregoing, in an aspect of this disclosure, there is provided a novel image forming apparatus in which load change and vibration is not generated in an intermediate transfer member and a secondary transfer member when a recording medium enters a secondary transfer nip irrespective of the employed recording medium (i.e., recording sheet). As a result, consistent good transfer of an image is achieved.

With reference to FIG. 1 through FIG. 7, a description is given below, of embodiments of the present invention. FIG. 1 is a schematic diagram illustrating an overview of a color copy machine as an example of an electrophotographic image forming apparatus employing a tandem-type indirect transfer method according to an embodiment of the present invention.

The configuration of the image forming apparatus includes a printing section 100, a sheet feed unit 200 that conveys the sheets of recording media to the printing section 100, a scanner 300 disposed on the printing section 100, and an automatic document feeder (ADF) 400 disposed on the scanner 300.

In the printing section 100, a transfer unit 17 is disposed in a vertical middle portion thereof. The transfer unit 17 includes an intermediate transfer belt 10 serving as the intermediate transfer member, formed into an endless loop. As shown in FIG. 1, viewed from the foreground, the shape of the intermediate transfer belt 10 has an inverted triangular shape and is looped around a driving roller 14, a following roller 15, and a secondary transfer opposing roller 16. As shown in FIG. 1, the intermediate transfer belt 10 revolves (also referred to as rotates) in a clockwise direction indicated by an arrow A by the rotational drive of the driving roller 14.

Four image forming units 18Y, 18M, 18C, and 18K which form toner images of yellow (Y), magenta (M), cyan (C), and black (K), respectively, are disposed above the intermediate transfer belt 10. The four image forming units 18Y, 18M, 18C, and 18K are disposed at regular intervals along and in the direction of movement of the intermediate transfer belt 10. The four image forming units 18Y, 18M, 18C, and 18K include photoreceptor drums 20Y, 20M, 20C, and 20K, respectively. Each of the photoreceptor drums 20Y, 20M, 20C, and 20K serves as an image carrier. Also, the four image forming units 18Y, 18M, 18C, and 18K include developing units 61Y, 61M, 61C, and 61K, respectively (only reference numerals 61Y and 61K of the developing units are indicated due to lack of space in the illustration; the rest is omitted.). Further, the four image forming units 18Y, 18M, 18C, and 18K include photoreceptor cleaning devices 63Y, 63M, 63C, and 63K, respectively (only reference numeral 63Y of the photoreceptor cleaning device is indicated due to lack of space in the illustration; the rest is omitted.).

It is to be noted that reference characters Y, M, C, and K denote the colors yellow, magenta, cyan, and black, respectively. To simplify the description, the reference characters Y, M, C, and K indicating colors are omitted herein unless otherwise specified.

Each of the photoreceptor drums 20Y, 20M, 20C, and 20K contacts the intermediate transfer belt 10 to each form primary transfer nips therebetween. Each of the photoreceptor drums 20Y, 20M, 20C, and 20K rotates in a counter clockwise direction (as shown by the arrow in FIG. 1) driven by a driving mechanism not shown in FIG. 1. The transfer unit 17 includes primary transfer rollers 62Y, 62M, 62C, and 62K in the inside of the intermediate transfer belt 10 formed into an endless loop. Each of the primary transfer rollers 62Y, 62M, 62C, and 62K presses the intermediate transfer belt 10 from the backside in the direction of the photoreceptor drums 20Y, 20M, 20C, and 20K at each of the primary transfer nips.

The developing units 61Y, 61M, 61C, and 61K develop with toners of the colors Y, M, C, and K an electrostatic latent image formed on each of the photoreceptor drums 20Y, 20M, 20C, and 20K. After each of the photoreceptor drums 20Y, 20M, 20C, and 20K rotate beyond each of the primary transfer nips, residual toner left on each of the photoreceptor drums 20Y, 20M, 20C, and 20K is removed by the photoreceptor cleaning devices 63Y, 63M, 63C, and 63K.

In the above-described configuration of the printing section 100, an image forming unit is configured of the four image forming units 18Y, 18M, 18C, and 18K disposed at regular intervals along and in the direction of movement of the intermediate transfer belt 10 to form toner images on the image carriers, i.e., photoreceptor drums 20Y, 20M, 20C, and 20K.

Before the surface of the photoreceptor drums 20Y, 20M, 20C, and 20K are scanned optically, a charging member (i.e., a charger) in each of the four image forming units 18Y, 18M, 18C, and 18K charges each surface of the photoreceptor drums 20Y, 20M, 20C, and 20K to a uniform charge. An optical writing unit 21 is disposed above the image forming unit. The optical writing unit 21, based upon image data sent from an external device such as a personal computer, optically scans the surface of the photoreceptor drums 20Y, 20M, 20C, and 20K, which rotate in the direction shown by the arrow in FIG. 1 to form electrostatic latent images on the surface of each of the photoreceptor drums 20Y, 20M, 20C, and 20K.

A secondary transfer roller 24 that serves as the secondary transfer member is disposed below the intermediate transfer belt 10. The secondary transfer roller 24 is disposed opposite the secondary transfer opposing roller 16 which supports the intermediate transfer belt 10 from the back surface of the intermediate transfer belt 10. A secondary transfer nip is formed at the contact between the peripheral surface of the intermediate transfer belt 10 and the secondary transfer roller 24. A sheet-shaped recording medium (hereinafter referred to as recording sheet) is conveyed to the secondary transfer nip at a predetermined timing. Accordingly, a composite toner image of four colors superimposed on each other that is formed on the intermediate transfer belt 10 is transferred onto the recording sheet at the secondary transfer nip.

In the scanner 300, a document that is placed onto a contact glass 32 is read with a reading sensor 36. The read image data is sent to a controller of the printing section 100. The controller, which is not shown in FIG. 1, controls a light source such as a laser diode or a LED in the optical writing unit 21 of the printing section 100 to scan optically based upon the image data received from the scanner 300.

More specifically, a laser light is emitted from the light source of the optical writing unit 21 for Y, M, C, and K to scan optically each surface of the photoreceptor drums 20Y, 20M, 20C, and 20K. As a result, the electrostatic latent images are formed on each surface of the photoreceptor drums 20Y, 20M, 20C, and 20K. Subsequently, each of the electrostatic latent images are developed into toner images of Y, M, C, and K by going through a predetermined developing process performed by each of the developing units 61Y, 61M, 61C, and 61K.

The sheet feed unit 200 includes a sheet bank 43, a plurality of sheet feed rollers 42 that conveys the recording sheet from a plurality of sheet cassettes 44 disposed within the sheet bank 43, a separating roller 45 that separates the recording sheet from the plurality of sheet cassettes 44 and guides the recording sheet to a sheet transport route 46, and a conveying roller 47 to convey the recording sheet to a sheet transport route 48 in the printing section 100.

It is to be noted that the feeding of the recording sheet can be also performed manually apart from feeding via the sheet feed unit 200. In the present embodiment, a manual feed tray 51, a sheet feed roller 50 to convey the recording sheet on the manual feed tray 51, and a separating roller 52 that separates the recording sheet sheet-by-sheet and conveys the recording sheet to a manual sheet transport route 53 are provided to the image forming apparatus to enable manual feeding of the recording sheet. The manual sheet transport route 53 and the sheet transport route 48 converge inside the printing section 100. A pair of timing rollers 49 (also referred to as "a pair of registration rollers") is provided in the vicinity of the end of the sheet transport route 48. The pair of timing rollers 49 sandwiches the recording sheet conveyed from the sheet transport route 48 between the pair of timing rollers and conveys the recording sheet at a predetermined timing to the secondary transfer nip.

In the above-described image forming apparatus, when copying a color image, the document to be copied is set on a document platform 30 in the ADF 400. Alternatively, the document to be copied may be set manually on the contact glass 32 of the scanner 300 by opening the ADF 400 and placing the document onto the contact glass 32 and closing the ADF 400 onto the document. When the document to be copied is set on the document platform 30 in the ADF 400, the document is conveyed onto the contact glass 32 after a start button of a scanning panel not shown in FIG. 1 is pressed. Accordingly, the scanner 300 starts, and a first travelling member 33 and a second travelling member 34 travel along the face of the document to be copied. The first travelling member 33 emits a light from a light source in the first travelling member 33. The light irradiates the surface of the document to be copied, and a reflected light from the surface of the document to be copied is reflected back to the first travelling member 33. The reflected light is then directed by the first travelling member 33 to the second travelling member 34. In the second travelling member 34, the reflected light is directed by a mirror in the second travelling member 34 to a reading sensor 36 via an image formation lens 35. As a result, the content of the document to be copied is read.

The printing section 100 feeds the recording sheet of a size in accordance with the image data from the sheet feed unit 200 or the manual feed tray 51 into the sheet transport route 48 or the manual sheet transport route 53 when image data is received from the scanner 300. Also, the driving roller 14 is rotationally driven by a driving motor not shown in FIG. 1, and the intermediate transfer belt 10 revolves in a clockwise direction.

At the same time, the charging process, the optical writing process, and the developing process with respect to the photoreceptor drums 20Y, 20M, 20C, and 20K are executed after the rotational drive of the photoreceptor drums 20Y, 20M, 20C, and 20K in the four image forming units 18Y, 18M, 18C, and 18K starts. The composite toner image of four colors is formed on the intermediate transfer belt 10 by sequentially superimposing the toner images of yellow, magenta, cyan, and black one atop the other at the respective primary transfer nips.

In the sheet feed unit 200, one of the plurality of sheet feed rollers 42 is selectively rotated in accordance with the size of the recording sheet to be used, and the recording sheet from one of three of the plurality of sheet cassettes 44 is fed. The recording sheets are separated sheet-by-sheet by the separating roller 45 and conveyed to the sheet transport route 46. From the sheet transport route 46, the recording sheet is conveyed to the sheet transport route 48 in the printing section 100 via the conveying roller 47.

In a case in which the manual feed tray 51 is used, the sheet feed roller 50 rotates and feeds the recording sheet on the manual feed tray 51. The separating roller 52 separates the recording sheet sheet-by-sheet and conveys the recording sheet to the manual sheet transport route 53. In the manual sheet transport route 53, the recording sheet is conveyed to the vicinity of the end of the sheet transport route 48.

The recording sheet, which is conveyed to the vicinity of the end of the sheet transport route 48 in the above-described routes, stops at the pair of timing rollers 49 by the front end of the recording sheet bumping into the pair of timing rollers 49. Then, the pair of timing rollers 49 rotates to feed the recording sheet to the secondary transfer nip in an appropriate timing such that the recording sheet is aligned with the composite toner image of four colors formed on the intermediate transfer belt 10 in the secondary transfer nip. In the secondary transfer nip, the recording sheet presses against the composite toner image of four colors formed on the intermediate transfer belt 10 and the composite toner image of four colors is transferred secondarily onto the recording sheet due to a transfer electric field and a nip pressure applied thereto.

The recording sheet with the secondarily transferred composite toner image of four colors is conveyed to a fixing device 25 by a sheet conveying belt 22 entrained around and stretched taut between a driving roller 23*a* and a following roller 23*b*. The recording sheet is interposed at a fixing nip formed between a pressing roller 27 and a fixing belt 26 in the fixing device 25, thereby fixing the composite toner image of four colors to the surface of the recording sheet due to heat and nip pressure applied thereto. Subsequently, the recording sheet with the fixed composite toner image of four colors is ejected by a pair of ejection rollers 56 onto an ejection tray 57 and is stacked thereto.

In a case of further forming an image on the other side of the recording sheet, the recording sheet with a fixed image on one side is conveyed to a sheet inversion device 58 by a switching pawl 55, which switches conveying routes after the recording sheet with the fixed image on one side is ejected from the fixing device 25. After the recording sheet with the fixed image on one side is inverted to the side with no image, the recording sheet is returned to the pair of timing rollers 49 and conveyed at a predetermined timing to the secondary transfer nip. Accordingly, a toner image is transferred secondarily to the recording sheet on the side with no image. The toner image is fixed on the recording sheet at the fixing device 25 and is ejected onto the ejection tray 57.

The intermediate transfer belt 10 is cleaned by a belt cleaning device not shown in FIG. 1 after passing through the secondary transfer nip. More specifically, residual toner remaining on the intermediate transfer belt 10 after transfer 10 is removed by the belt cleaning device before the intermediate transfer belt 10 enters the primary transfer nip for yellow that is disposed at the uppermost stream of the primary transfer process.

Figure 2:
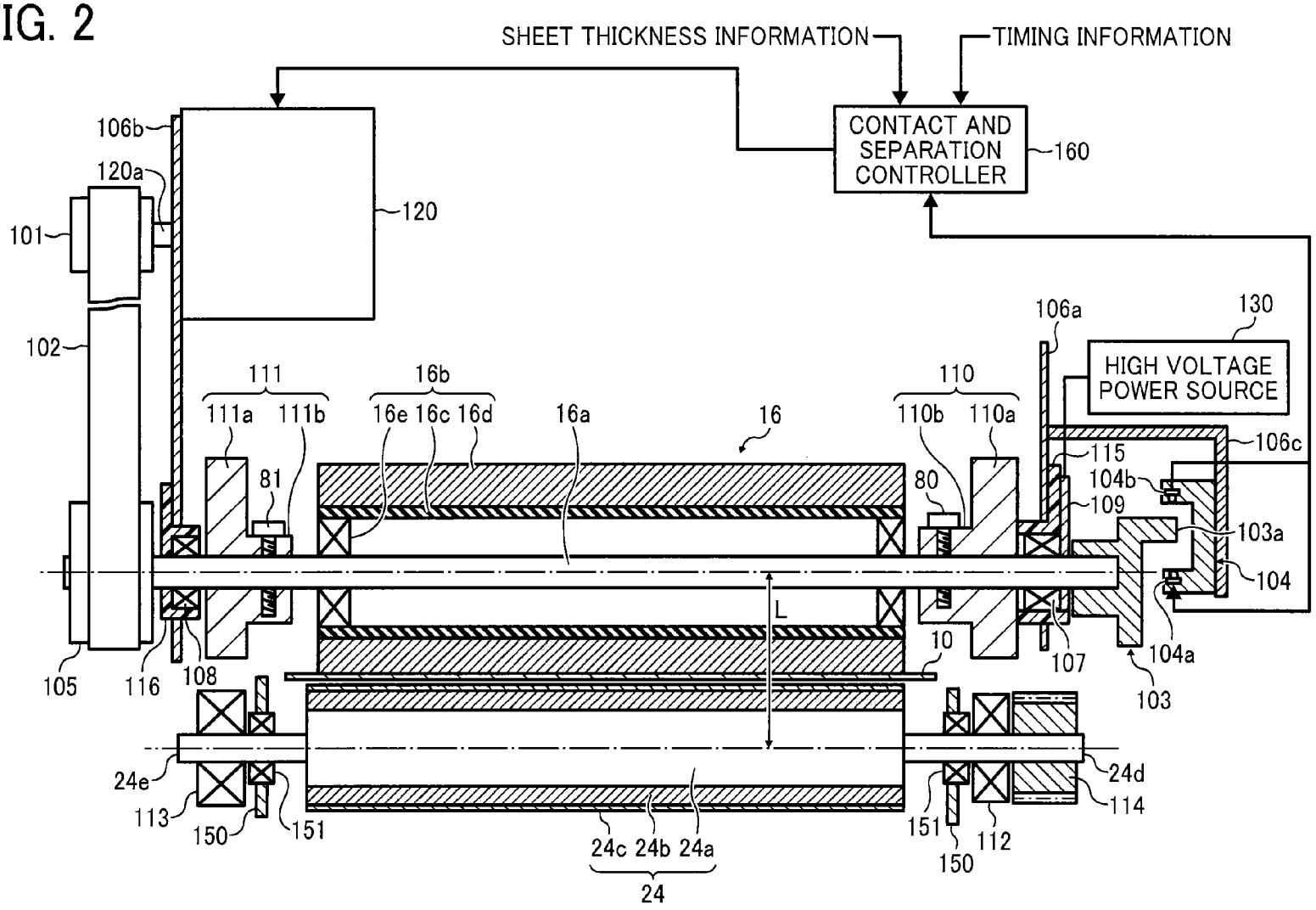
FIG. 2 is an enlarged longitudinal sectional view of a secondary transfer part in the image forming apparatus of FIG. 1.

A detailed description of a configuration of the secondary transfer part of the image forming apparatus is now given with reference to FIG. 2. FIG. 2 is an enlarged longitudinal sectional view of the secondary transfer part in the image forming apparatus. FIG. 2 illustrates the secondary transfer roller 24 and the secondary transfer opposing roller 16 shown in FIG. 1.

The secondary transfer roller 24 includes a cylindrical hollow metal core 24*a*, an elastic layer 24*b* fixed on the surface of the outer circumference of the hollow metal core 24*a*, and a surface layer 24*c* coated on the surface of the outer circumference of the elastic layer 24*b*. A first shaft 24*d* and a second shaft 24*e* protrude from and extend beyond the face of both ends of the hollow metal core 24*a* in the axial direction. A first free rotation roller 112 and a second free rotation roller 113 are fixed on the first shaft 24*d* and the second shaft 24*e*, respectively.

A driving gear 114 is fixed on the end portion of the first shaft 24*d* of the secondary transfer roller 24. The driving gear 114 is driven by a secondary transfer driving motor not shown in FIG. 2 via a transmission mechanism (e.g., a wheel train or belt mechanism) not shown in FIG. 2. When the intermediate transfer belt 10 is rotated by a driving motor not shown in FIG. 2, the secondary transfer roller 24 is also rotated by the secondary transfer driving motor. The moving speed of the surface the intermediate transfer belt 10 and the speed of the surface of the outer circumference of the secondary transfer roller 24 are made to be the same speed.

In the present embodiment, the hollow metal core 24*a* of the secondary transfer roller 24 is formed of stainless steel or aluminum but is not limited to these materials. Preferably, the hardness of the elastic layer 24*b* is equal to or less than approximately 70 degrees in reference to JIS-A hardness scale. If the elastic layer 24*b* is too soft, various failures may occur when a cleaning blade not shown in FIG. 2 contacts the secondary transfer roller 24. Thus, it is preferable that the elastic layer 24*b* is equal to or greater than approximately 40 degrees in reference to JIS-A hardness scale.

In a configuration in which the cleaning blade does not contact the secondary transfer roller 24, the elastic layer 24*b* can be soft. As a result, the impact upon the entering of and the exiting of the recording sheet from the secondary transfer member can be reduced and image failure occurring from the impact can be reduced. In such a configuration, the hardness of the elastic layer 24*b* is preferably in a range from approximately 40 degrees to approximately 50 degrees on the Asker-C hardness scale.

The elastic layer 24*b* is formed of a conductive rubber material with a resistance value adjusted to approximately 7.5 Log Ω. The conductive rubber material includes, but is not limited to a conductive epichlorohydrin rubber, an ethylene propylene diene monomer (EPDM) rubber or a silicone rubber with carbon dispersed, a nitrile butadiene rubber (NBR) or an urethane rubber including an ion conductivity capability.

The reason for adjusting the electrical resistance of the elastic layer 24*b* to a predetermined range is to manage a problem that occurs when using a comparatively small recording sheet such as an A5 size recording sheet with respect to the size of the secondary transfer roller 24 in the axial direction. More specifically, it is to prevent a concentration of transfer current at places where the intermediate transfer belt 10 and the secondary transfer roller 24 directly contact each other with no interposing recording sheet in the secondary transfer nip when using a comparatively small sized recording sheet. This concentration of transfer current is prevented by making the value of the electrical resistance of the elastic layer 24*b* larger than the electrical resistance of the recording sheet.

A foamed rubber having an elasticity of from approximately 40 degrees to approximately 50 degrees on the Asker-C hardness scale can be used as the conductive rubber material for the elastic layer 24*b*. In a configuration of using the foamed rubber for the elastic layer 24*b*, a secondary transfer nip having an area to some extent in the direction of the conveyance of the recording sheet can be formed by flexibly changing the elastic layer 24*b* in the direction of thickness within the secondary transfer nip.

It is preferable that the elastic layer 24*b* has a drum shape in which the external diameter of the center portion is slightly larger than the external diameter of both ends. The drum shape prevents loss of pressure at the center portion upon generation of flexure when forming the secondary transfer nip by pressing the secondary transfer roller 24 with a later-described compression coil spring in the direction of the intermediate transfer belt 10.

Many of the above-described rubber materials show attributes of good chemical affinity with toner and have a comparatively large friction coefficient. Therefore, the elastic layer 24*b* formed of rubber is coated with the surface layer 24*c* in the above-described embodiment. The surface layer 24*c* reduces toner adhesion to the surface of the secondary transfer roller 24, and reduces the load of sliding friction in a configuration in which the cleaning blade contacts the secondary transfer roller 24.

It is preferable that the material employed for the surface layer 24*c* includes a fluorine resin including a resistance adjustment material such as carbon or an ion conductivity agent that shows good toner separation and has a low friction coefficient. It is to be noted that the surface layer 24*c* can be omitted.

Figure 3:
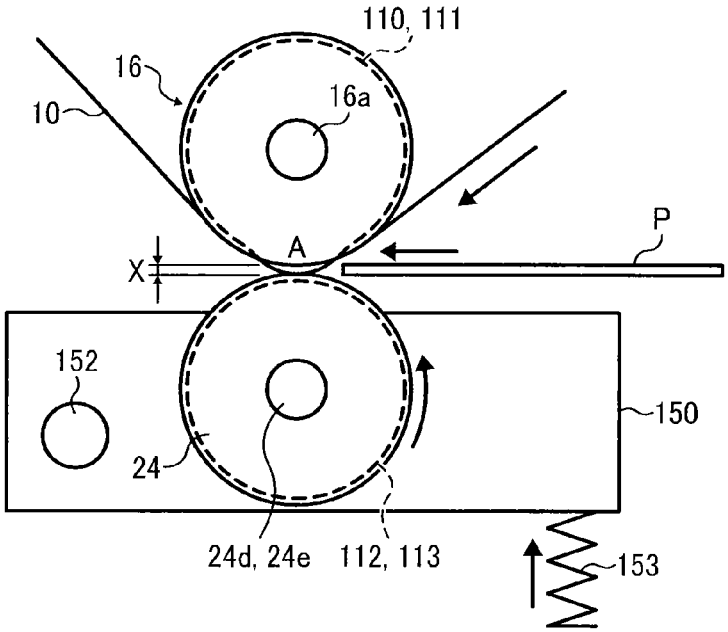
FIG. 3 is a schematic lateral view of FIG. 2 illustrating a state of a secondary transfer nip between an intermediate transfer belt and a secondary transfer roller just before a recording sheet enters.

In the above-described configuration, the secondary transfer roller 24 presses against the intermediate transfer belt 10 looped around the secondary transfer opposing roller 16. More specifically, a roller unit supporting member 150 supports the secondary transfer roller 24 via the first shaft 24*d*, the second shaft 24*e*, and ball bearings 151. As shown in FIG. 3, the roller unit supporting member 150 is rotatably supported by a supporting shaft 152 disposed at one end of the roller unit supporting member 150 in the longitudinal direction. The roller unit supporting member 150 is rotatable with respect to a device fixing member not shown in FIG. 3. The compression coil spring 153 is disposed between the other end of the roller unit supporting member 150 in the longitudinal direction and the device fixing member.

The compression coil spring 153 presses the roller unit supporting member 150 such that the roller unit supporting member 150, in view of FIG. 3, rotates to the left around the supporting shaft 152. As a result, the secondary transfer roller 24 presses against the intermediate transfer belt 10 serving as the intermediate transfer member. As described above, the roller unit supporting member 150, the compression coil spring 153, and so forth constitute a biasing mechanism capable of pressing the secondary transfer roller 24 in the direction to contact with the intermediate transfer belt 10.

Returning to FIG. 2, the secondary transfer opposing roller 16 with the intermediate transfer belt 10 looped around the secondary transfer opposing roller 16 includes a roller member 16*b* and a penetrating shaft member 16*a*. The roller member 16*b* constitutes a cylindrical main member of the secondary transfer opposing roller 16. The penetrating shaft member 16*a* penetrates the center of rotation in the rotating axial direction of the roller member 16*b* and rotatably supports the roller member 16*b*. The penetrating shaft member 16*a* is formed of a metal, and the roller member 16*b* rotates freely on the surface of the outer circumference of the penetrating shaft member 16*a*.

The roller member 16*b* serving as the main member includes a drum shaped hollow metal core 16*c*, an elastic layer 16*d* formed of an elastic material fixed on the surface of the outer circumference of the hollow metal core 16*c*, and each ball bearing 16*e* press-fitted into both ends of the hollow metal core 16*c* in the axial direction. Each ball bearing 16*e* supports the hollow metal core 16*c* and rotates with the hollow metal core 16*c* on the surface of the penetrating shaft member 16*a*. The elastic layer 16*d* is fixed on the surface of the outer circumference of the hollow metal core 16*c*.

The penetrating shaft member 16*a* is supported rotatably by a first bearing 107 fixed to a first side plate 106*a* of the transfer unit 17 shown in FIG. 1 via an insulating member 115, and a second bearing 108 fixed to a second side plate 106*b* of the transfer unit 17 shown in FIG. 1 via an insulating member 116. The penetrating shaft member 16*a* is not rotatably driven and is stationary most of the time during a print job. The roller member 16*b* rotates freely around the penetrating shaft member 16*a* in accordance with the rotation of the intermediate transfer belt 10.

The elastic layer 16*d* fixed on the surface of the outer circumference of the hollow metal core 16*c* is formed of ethylene propylene (EP) rubber material with a resistance adjusted to equal to or less than approximately 6.0 Log Ω. The elasticity of the EP rubber employed as the rubber material forming the elastic layer 16*d* is preferably approximately 70 degrees on the JIS-A hardness scale.

A cam member serving as a contact member to contact the secondary transfer roller 24 is disposed at both ends of the penetrating shaft member 16*a* in the longitudinal direction in an area outside the roller member 16*b*. Each cam member is fixed to the penetrating shaft member 16*a* and rotates jointly with the penetrating shaft member 16*a*.

More specifically, a first eccentric cam 110 is fixed at one end portion of the penetrating shaft member 16*a* in the longitudinal direction. The first eccentric cam 110 is formed of a single-piece including an eccentric cam member 110*a* and a cylindrical-shaped roller member 110*b* lined in the axial direction. The first eccentric cam 110 is fixed to the penetrating shaft member 16*a* by a bolt 80 fastened to the roller member 110*b*. The bolt 80 penetrates the penetrating shaft member 16*a*. Similar to the first eccentric cam 110, a second eccentric cam 111 formed of a single-piece including an eccentric cam member 111*a* and a cylindrical shaped roller member 111*b* is fixed at the other end portion of the penetrating shaft member 16*a* in the longitudinal direction. The second eccentric cam 111 is fixed to the penetrating shaft member 16*a* by a bolt 81. As will be described later, the first eccentric cam 110 and the second eccentric cam 111 refer to rotatable cam members at a first position and a second position.

A drive receiving pulley 105 is fixed to the penetrating shaft member 16*a* outside the second bearing 108 fixed to the second side plate 106*b* in the axial direction. A detecting disc 103 is fixed to the penetrating shaft member 16*a* outside the first bearing 107 fixed to the first side plate 106*a* in the axial direction. A sensor bracket 106*c* is fixed to the first side plate 106*a*. An optical sensor 104 is fixed to the sensor bracket 106*c*.

A cam driving motor 120 is fixed to the second side plate 106*b* of the transfer unit 17 shown in FIG. 1. A motor pulley 101 is fixed to a rotation shaft 120*a* of the cam driving motor 120. A timing belt 102 is entrained around the drive receiving pulley 105 and the motor pulley 101. The rotational drive of the cam driving motor 120 is transmitted to the drive receiving pulley 105 fixed to the penetrating shaft member 16*a* via the timing belt 102.

With the above-described configuration, the penetrating shaft member 16*a* can be rotated by driving the cam driving motor 120. It is to be noted that even if the penetrating shaft member 16*a* is rotated, the roller member 16*b* can rotate freely on the penetrating shaft member 16*a* and does not inhibit the following rotation of the roller member 16*b* by the intermediate transfer belt 10. A stepping motor may be used for the cam driving motor 120. In this configuration, the rotation angle (driving amount) of the rotation shaft 120*a* can be freely set without providing a rotation angle detector such as an encoder. A contact-separation controller 160 controls the timing of the rotational drive and the driving amount of the cam driving motor 120.

When the rotation of the penetrating shaft member 16*a* is stopped at a predetermined rotation angle, the eccentric cam member 110*a* of the first eccentric cam 110 and the eccentric cam member 111*a* of the second eccentric cam 111 contact the first free rotation roller 112 and the second free rotation roller 113 disposed on the axis of the secondary transfer roller 24, respectively. As a result, the secondary transfer roller 24 resists and presses back against the compression coil spring 153 (shown in FIG. 3) of the roller unit supporting member 150. By distancing the secondary transfer roller 24 away from the secondary transfer opposing roller 16 (and by extension, away from the intermediate transfer belt 10), a distance L between the shaft of the secondary transfer roller 24 and the shaft of the secondary transfer opposing roller 16 is increased.

The secondary transfer opposing roller 16 serving as a rotatable supporting member allows the free rotation of the roller member 16*b* on the surface of the outer circumference of the penetrating shaft member 16*a*, which penetrates the roller member 16*b* having a cylindrical shape. When the penetrating shaft member 16*a* is rotated, the first eccentric cam 110 and the second eccentric cam 111 fixed to each end of the penetrating shaft member 16*a* in the axial direction rotate jointly with the penetrating shaft member 16*a*. Thus, the first eccentric cam 110 and the second eccentric cam 111 on each end of the penetrating shaft member 16*a* can be rotated by providing a drive transmitting mechanism to transmit rotation to the penetrating shaft member 16*a* to one end of the penetrating shaft member 16*a* in the axial direction.

In the above-described image forming apparatus, the hollow metal core 24*a* of the secondary transfer roller 24 is grounded, and a secondary transfer bias with a polarity that is the same as that of the toner is applied to the hollow metal core 16*c* of the secondary transfer opposing roller 16. Accordingly, a secondary transfer electric field, which electrostatically moves the toner image from the secondary transfer opposing roller 16 to the secondary transfer roller 24 within the secondary transfer nip, is formed between the secondary transfer opposing roller 16 and the secondary transfer roller 24.

The first bearing 107, which rotatably supports the metal penetrating shaft member 16*a* of the secondary transfer opposing roller 16, is formed of a conductive slide bearing. A terminal plate 109 is provided to the conductive first bearing 107. The terminal plate 109 is supplied with the secondary transfer bias voltage outputted by a high-voltage power source 130. The secondary transfer bias voltage is conducted to the secondary transfer opposing roller 16 via the conductive first bearing 107. In the secondary transfer opposing roller 16, the secondary transfer bias voltage is conducted in the order of the metal penetrating shaft member 16*a*, the metal ball bearing 16*e*, the hollow metal core 16*c*, and the conductive elastic layer 16*d*.

The first eccentric cam 110, the second eccentric cam 111, and the drive receiving pulley 105 are formed of electrically insulating materials such as resin and do not conduct the secondary transfer bias voltage. The secondary transfer bias voltage is not conducted to the first side plate 106*a* of the transfer unit due to the insulating member 115 placed in between the first bearing 107 and the first side plate 106*a*. Similarly, the secondary transfer bias voltage is not conducted to the second side plate 106*b* of the transfer unit due the insulating member 116 placed in between the second bearing 108 and the second side plate 106*b*.

The detecting disc 103 fixed to one end of the penetrating shaft member 16*a* includes a detecting member 103*a* that rises in the axial direction at a predetermined position in the direction of rotation of the penetrating shaft member 16*a*. When the penetrating shaft member 16*a* comes to a predetermined rotation angle range, the detecting member 103*a* of the detecting disc 103 comes to a position between a light emitting element 104*a* and a light receiving element 104*b* of the optical sensor 104 attached to the sensor bracket 106*c*. Accordingly, the light path between the light emitting element 104*a* and the light receiving element 104*b* is blocked. The light receiving element 104*b* of the optical sensor 104 transmits a signal to the contact-separation controller 160 when light from the light emitting element 104*a* is received.

The contact-separation controller 160 enables the light emitting element 104*a* of the optical sensor 104 to emit light. Based upon the timing at which the signal from the light receiving element 104*b* is interrupted and based upon the number of rotation that the cam driving motor 120 makes after the signal from the light receiving element 104*b* is interrupted, the contact-separation controller 160 obtains the rotation angle of the eccentric cam member 110*a* of the first eccentric cam 110 and the eccentric cam member 111*a* of the second eccentric cam 111 fixed to the penetrating shaft member 16*a*.

As described above, the eccentric cam member 110*a* and the eccentric cam member 111*a* contact the first free rotation roller 112 and the second free rotation roller 113 provided on the secondary transfer roller 24 at a predetermined rotation angle, thereby pressing the secondary transfer roller 24 back in the direction away from (hereinafter referred to as pressing down) the secondary transfer opposing roller 16. The pressing back amount (hereinafter referred to as pressing down amount) is determined by the rotation angle of the eccentric cam member 110*a* and the eccentric cam member 111*a*. As the amount of movement of the secondary transfer roller 24 being pressed down increases, the distance L between the shaft of the secondary transfer opposing roller 16 and the shaft of the secondary transfer roller 24 increases.

The first free rotation roller 112 is provided rotatably on the first shaft 24*d* of the secondary transfer roller 24. The first free rotation roller 112 is a ball bearing with an outer diameter slightly smaller than the secondary transfer roller 24. The first free rotation roller 112 can rotate freely on the surface of the outer circumference of the first shaft 24*d*. The second free rotation roller 113 is provided rotatably on the second shaft 24*e* of the secondary transfer roller 24 and has the same configuration as that of the first free rotation roller 112.

As described above, with respect to the secondary transfer opposing roller 16, the eccentric cam member 110*a* of the first eccentric cam 110 fixed to the penetrating shaft member 16*a* and the eccentric cam member 111*a* of the second eccentric cam 111 fixed to the penetrating shaft member 16*a* contact the first free rotation roller 112 and the second free rotation roller 113 at a predetermined rotation angle. More specifically, the eccentric cam member 110*a* of the first eccentric cam 110 fixed to one end of the penetrating shaft member 16*a* contacts the first free rotation roller 112 of the secondary transfer roller 24. At the same time, the eccentric cam member 111*a* of the second eccentric cam 111 fixed to the other end of the penetrating shaft member 16*a* contacts the second free rotation roller 113 of the secondary transfer roller 24.

The rotation of the first free rotation roller 112 and the second free rotation roller 113 is blocked when the eccentric cam member 110*a* and the eccentric cam member 111*a* contact the first free rotation roller 112 and the second free rotation roller 113, respectively. However, this does not interfere with the rotation of the secondary transfer roller 24. Even when the rotation of the first free rotation roller 112 and the second free rotation roller 113 is stopped, the first free rotation roller 112 and the second free rotation roller 113 are ball bearings, thereby allowing the first shaft 24*d* and the second shaft 24*e* of the secondary transfer roller 24 to rotate freely independent of the first free rotation roller 112 and the second free rotation roller 113.

By stopping the rotation of the first free rotation roller 112 and the second free rotation roller 113 by the eccentric cam member 110*a* and the eccentric cam member 111*a*, the generation of contact friction between the first free rotation roller 112 and the eccentric cam member 110*a*, and the second free rotation roller 113 and the eccentric cam member 111*a* can be prevented. In addition, an increase in the torque of the motor driving the secondary transfer roller 24 and the motor driving the intermediate transfer belt 10 caused by friction can be prevented.

Figure 4:
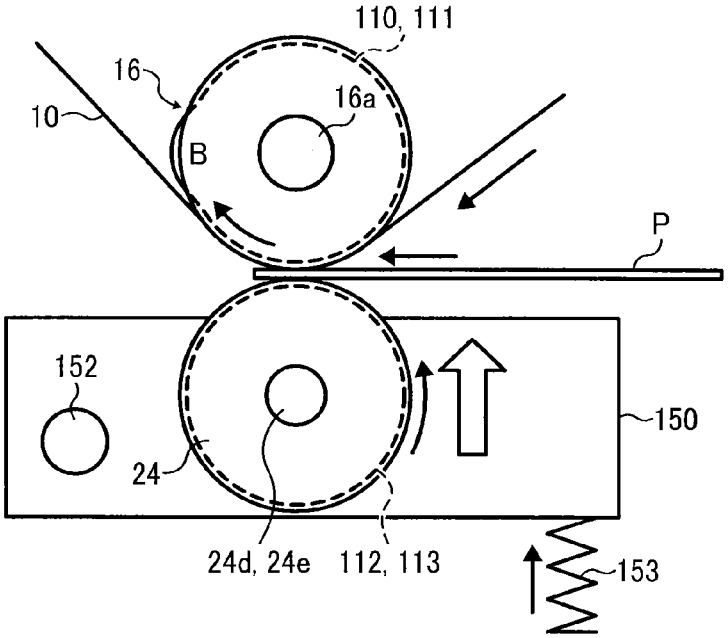
FIG. 4 is a schematic lateral view of FIG. 2 illustrating a state in which the recording sheet has entered the secondary transfer nip.
Figure 5:
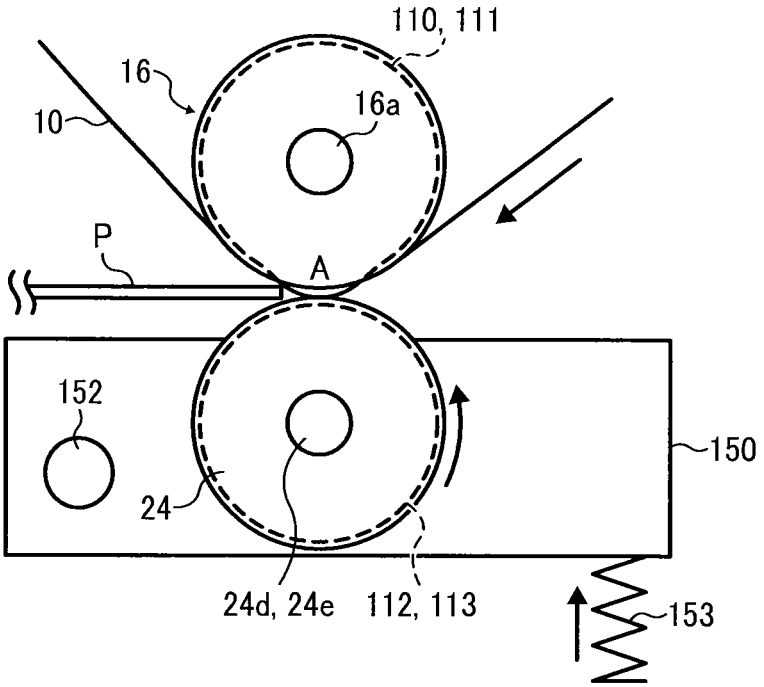
FIG. 5 is a schematic lateral view of FIG. 2 illustrating a state in which the recording sheet has exited the secondary transfer nip.

With reference to FIG. 3 through FIG. 7, a description is provided of movement of the intermediate transfer belt 10 and the secondary transfer roller 24 at the secondary transfer nip. FIGS. 3 through 5 are enlarged longitudinal sectional views of main parts at the secondary transfer nip shown in FIG. 2. FIG. 3 illustrates a state just before the recording sheet enters the secondary transfer nip between the intermediate transfer belt 10 and the secondary transfer roller 24. FIG. 4 illustrates a state in which the recording sheet has entered the secondary transfer nip. FIG. 5 illustrates a state in which the recording sheet has exited the secondary transfer nip.

A description is provided of the movement of the secondary transfer roller 24 when a thick recording sheet is passed through the secondary transfer nip. As shown in FIG. 3, when a recording sheet P enters the secondary transfer nip, the rotation of the penetrating shaft member 16*a* of the secondary transfer opposing roller 16 is stopped at a position (hereinafter referred to as cam position A) at which the eccentric cam member 110*a* of the first eccentric cam 110 and the eccentric cam member 111*a* of the second eccentric cam 111 provided on the secondary transfer opposing roller 16 contact the first free rotation roller 112 and the second free rotation roller 113 provided on the secondary transfer roller 24, respectively.

At the cam position A, which is also referred to as the first position, the secondary transfer roller 24 is separated from the intermediate transfer belt 10 by pressing down the compression coil spring 153 serving as the biasing mechanism, thereby forming a predetermined space X at the secondary transfer nip. More specifically, the first eccentric cam 110 and the second eccentric cam 111 are positioned at the cam position A as the first position when the recording sheet P enters the secondary transfer nip, thereby pressing down the secondary transfer roller 24 and hence forming a predetermined space X between the secondary transfer roller 24 and the intermediate transfer belt 10.

By allowing the recording sheet P to enter the secondary transfer nip while forming the predetermined space X between the secondary transfer roller 24 and the intermediate transfer belt 10, a significant load change with respect to the secondary transfer roller 24 and the intermediate transfer belt 10 can be prevented when the recording sheet P enters the secondary transfer nip even when the recording sheet P is relatively thick.

However, if the recording sheet P is passed through the secondary transfer nip while the secondary transfer roller 24 is pressed down, transferability of the toner image may be degraded due to lack of sufficient nip pressure at the secondary transfer nip. A pronounced decline in the transferability is particularly seen when a recording sheet with a coarse surface is employed. In view of this, the penetrating shaft member 16*a* of the secondary transfer opposing roller 16 is rotated immediately before the recording sheet P enters the secondary transfer nip so that the first eccentric cam 110 and the second eccentric cam 111 provided on the secondary transfer opposing roller 16 come to a cam position B (also referred to as the second position) at which the first eccentric cam 110 and the second eccentric cam 111 do not contact the first free rotation roller 112 and the second free rotation roller 113 provided on the secondary transfer roller 24 after the recording sheet P enters the secondary transfer nip. As shown in FIG. 4, at the second position, the pressing down that causes the secondary transfer roller 24 to separate from the intermediate transfer belt is cancelled, and hence the space X at the secondary transfer nip between the secondary transfer roller 24 and the intermediate transfer belt 10 is eliminated.

Subsequently, during the secondary transfer during which the recording sheet P is conveyed and the toner image is transferred thereto in the secondary transfer nip, the first eccentric cam 110 and the second eccentric cam 111 provided on the secondary transfer opposing roller 16 remain at the cam position B at which the first eccentric cam 110 and the second eccentric cam 111 do not contact the first free rotation roller 112 and the second free rotation roller 113 provided on the secondary transfer roller 24.

Therefore, while the toner image is secondarily transferred to the recording sheet P, the secondary transfer roller 24 is pressed against the secondary transfer opposing roller 16 by the compression coil spring 153 shown in FIG. 4 and the recording sheet P is conveyed between the secondary transfer roller 24 and the intermediate transfer belt 10. Accordingly, sufficient nip pressure is obtained, and the toner image is transferred well.

As shown in FIG. 5, as the recording sheet P exits the secondary transfer nip, the penetrating shaft member 16*a* of the secondary transfer opposing roller 16 is rotated and stopped such that the first eccentric cam 110 and the second eccentric cam 111 provided on the secondary transfer opposing roller 16 contact again the first free rotation roller 112 and the second free rotation roller 113 provided on the secondary transfer roller 24, respectively. As a result, a load change with respect to the secondary transfer roller 24 and the intermediate transfer belt 10 can be reduced when the recording sheet P exits the secondary transfer nip.

When forming a toner patch on the intermediate transfer belt 10 to adjust toner concentration or when forming a discharge pattern to discharge degraded toner, at a time between successive recording media during image formation, it is preferable to form the predetermined space X between the secondary transfer roller 24 and the intermediate transfer belt 10. In this case, it is preferable that the space X be approximately 1 mm.

The contact-separation controller 160 controls the cam driving motor 120 shown in FIG. 2 to rotate the penetrating shaft member 16*a* of the secondary transfer opposing roller 16 and controls contact and separation of the secondary transfer roller 24 relative to the intermediate transfer belt 10 The contact-separation controller 160 is a contact and separation control mechanism. A main controller including a micro computer that controls the printing section 100 of the image forming apparatus shown in FIG. 1 may serve as the contact-separation controller 160.

It is to be noted that just before the recording sheet P enters the secondary transfer nip, it is necessary to initiate the rotation (referred to as start timing of a contact action $\alpha$) of the first eccentric cam 110 and the second eccentric cam 111 to eliminate the space X from the state in which the space X has been formed between the secondary transfer roller 24 and the intermediate transfer belt 10. In a case in which the start timing of the contact action $\alpha$ is always prior to a certain time before the front end of the recording sheet P enters the secondary transfer nip, the space X between the secondary transfer roller 24 and the intermediate transfer belt 10 is always substantially the same when the front end of the recording sheet P enters the secondary transfer nip.

In a case in which the recording sheet P is relatively thick, when the front end of the recording sheet P enters the secondary transfer nip, the space X may be too small, causing the recording sheet P to strike the secondary transfer roller 24 and the intermediate transfer belt 10 and hence resulting in load change or undesirable vibration. By contrast, in a case in which the recording sheet P is relatively thin, the space X between the secondary transfer roller 24 and the intermediate transfer belt 10 may be too large, causing a conveyance failure when the front end of the recording sheet P enters the secondary transfer nip or causing return shock to the secondary transfer roller 24 and the intermediate transfer belt 10 when the space X is eliminated.

According to the present illustrative embodiment, the contact-separation controller 160 shown in FIG. 2 is inputted with recording sheet thickness information and changes the above-described start timing of the contact action α in accordance with the thickness of the recording sheet P. By the control of the contact-separation controller 160, a value obtained by subtracting the thickness of the recording sheet P from the space X between the secondary transfer roller 24 and the intermediate transfer belt 10 at the point of entry of the front end of the recording sheet P into the secondary transfer nip is made approximately constant irrespective of the thickness of the recording sheet P. Accordingly, the image failure caused by load change, vibration, conveyance failure, and return shock can be prevented.

Figure 6:
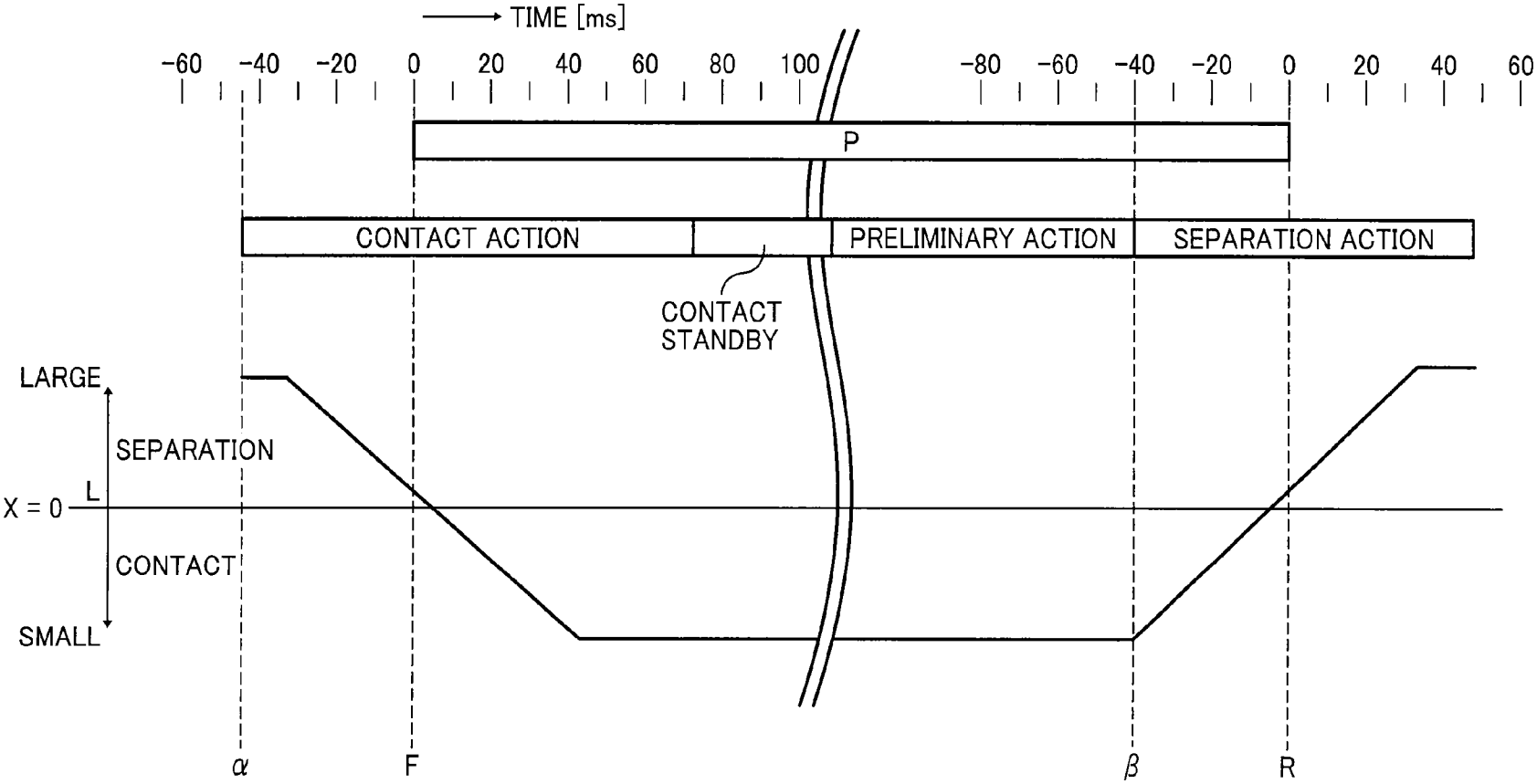
FIG. 6 is a timing chart illustrating a start timing of a contact action in an example using a thick recording sheet.
Figure 7:
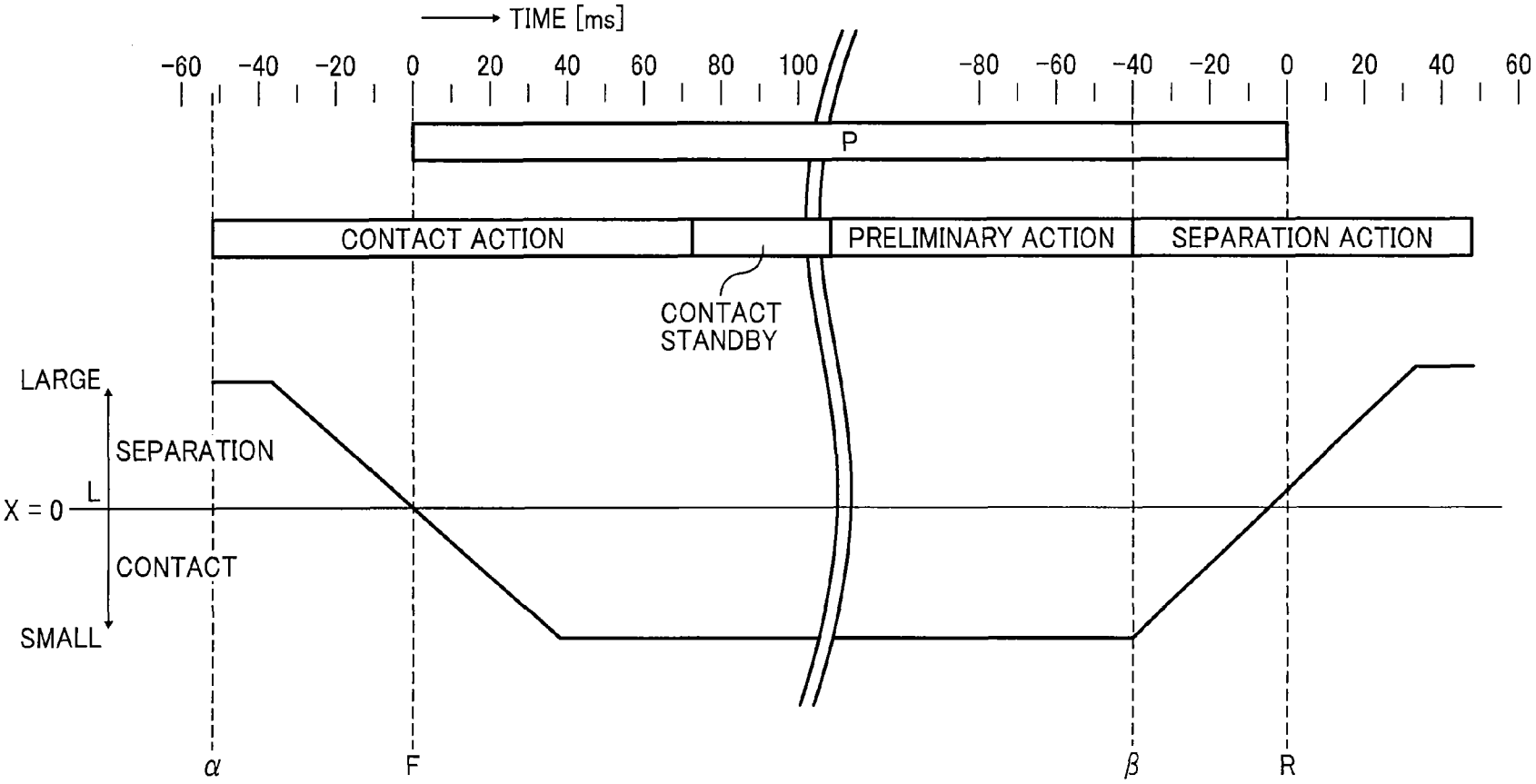
FIG. 7 is a timing chart illustrating a start timing of a contact action in an example using a thin recording sheet.

An example of a change in the start timing of the contact action α is described with reference to FIGS. 6 and 7. FIGS. 6 and 7 are timing charts illustrating the relation of a time period during which the recording sheet P passes through the secondary transfer nip, a change in the distance L between the shafts of the secondary transfer roller 24 and the secondary transfer opposing roller 16 caused by the rotation of the first eccentric cam 110 and the second eccentric cam 111, and the movement thereof. FIG. 6 illustrates an example using a thick recording sheet, and FIG. 7 illustrates an example using a thin recording sheet.

In each figure, the numerical value at the top represents time in millisecond (ms). A point at which the front end of the recording sheet P enters the secondary transfer nip is represented by F and a point at which the rear end of the recording sheet P exits the secondary transfer nip is represented by R. F and R are reference points with a value of 0. The time prior to each reference point is a minus time, and the time after each reference point is a plus time. The time is shown at 20 ms intervals.

A solid line represents a change in the distance L between the shafts of the secondary transfer roller 24 and the secondary transfer opposing roller 16 caused by the rotation of the first eccentric cam 110 and the second eccentric cam 111. A horizontal line at the center of the change represents the distance L between the shafts of the secondary transfer roller 24 and the secondary transfer opposing roller 16 when the space X at the secondary transfer nip is zero (X=0). The area above the horizontal line (an area at which the distance between the shafts is large) represents a state in which the secondary transfer roller 24 and the secondary transfer opposing roller 16 are separated. As the distance L between the shafts increases, the space X also increases. The area below the horizontal line (the area at which the distance between the shafts is small) represents a state in which the secondary transfer roller 24 contacts the secondary transfer opposing roller 16. As the distance L between the shafts decreases, the outer circumference of the secondary transfer roller 24 elastically deforms and digs in, thereby increasing the nip pressure at the secondary transfer nip.

As shown in FIG. 3, the contact action is started by rotating the first eccentric cam 110 and the second eccentric cam 111 in a clockwise or counter clockwise direction from a state of the cam position A serving as the first position. At the cam position A, the first eccentric cam 110 and the second eccentric cam 111 abut the first free rotation roller 112 and the second free rotation roller 113, respectively. The distance L between shafts is at its maximum. As a large diameter protruding portion of the first eccentric cam 110 and a large diameter protruding portion of the second eccentric cam 111 disengage from the first free rotation roller 112 and the second free rotation roller 113, respectively, the distance L between shafts gradually becomes smaller. As shown in FIG. 4, when the first eccentric cam 110 and the second eccentric cam 111 separate completely from the first free rotation roller 112 and the second free rotation roller 113, respectively, the rotation of the first eccentric cam 110 and the second eccentric cam 111 is stopped at the cam position B serving as the second position. The distance L between shafts is at its minimum. The action from the start timing of the contact action α to when the rotation of the first eccentric cam 110 and the second eccentric cam 111 is stopped at the cam position B is referred to as "contact action." When the space X approaches zero during the contact action, the time becomes zero and the front end of the recording sheet P enters the secondary transfer nip.

The time period in which the rotation of the first eccentric cam 110 and the second eccentric cam 111 is stopped and maintained at the cam position B serving as the second position is referred to as "contact standby."

When the rear end of the recording sheet P approaches, the first eccentric cam 110 and the second eccentric cam 111 are rotated again in a clockwise or counter clockwise direction. The distance L between shafts is still at its minimum while a circular portion of the first eccentric cam 110 and a circular portion of the second eccentric cam 111, with same radii, are opposing the first free rotation roller 112 and the second free rotation roller 113, respectively. The circular portion of the first eccentric cam 110 and the circular portion of the second eccentric cam 111 do not abut the first free rotation roller 112 and the second free rotation roller 113, respectively. The time period in which the first eccentric cam 110 and the second eccentric cam 111 are rotated and the circular portion of the first eccentric cam 110 and the second eccentric cam 111 do not abut the first free rotation roller 112 and the second free rotation roller 113 is "preliminary action."

When the first eccentric cam 110 and the second eccentric cam 111 gradually contact anew the first free rotation roller 112 and the second free rotation roller 113, the distance L between shafts gradually becomes larger. As shown in FIG. 5, the rotation is stopped at the cam position A serving as the first position. The distance L between shafts is again at its maximum. The period in which the first eccentric cam 110 and the second eccentric cam 111 gradually contact anew up until the stopping of rotation is "separation action." During the separation action, the rear end of the recording sheet P exits the secondary transfer nip at the point in which the space X is slightly generated.

In the case of using a thick recording sheet for the recording sheet P as shown in FIG. 6, the start timing of the contact action α is set to a point of 45 ms prior to entry of the front end of the recording sheet P, and the rotation of the first eccentric cam 110 and the second eccentric cam 111 is started to start the contact action. After starting, the distance L between shafts becomes smaller. At the time zero at which the front end of the recording sheet P enters the secondary transfer nip, the space X is not yet zero. A space X remains between the secondary transfer roller 24 and the intermediate transfer belt 10. By making the remaining space X a value approximately equal to the thickness of the recording sheet P and not smaller, the possibility of generating load change and vibration upon the entry of the front end of the recording sheet P is removed.

By contrast, in the case of using a thin recording sheet for the recording sheet P as shown in FIG. 7, the start timing of the contact action α is set to a point of 52 ms (a point earlier than when using the thick recording sheet) prior to entry of the front end of the recording sheet P, and the rotation of the first eccentric cam 110 and the second eccentric cam 111 is started to start the contact action. After starting, the distance L between shafts becomes smaller. At the time zero in which the front end of the recording sheet P enters the secondary transfer nip, the space X is approximately zero. By lightly sandwiching the entering front end of the thin recording sheet used as the recording sheet P between the secondary transfer roller 24 and the intermediate transfer belt 10, the possibility of generating load change and return shock is removed.

In the examples shown in FIG. 6 and FIG. 7, the start timing of the separation action β just before the rear end of the recording sheet P exits the secondary transfer nip is the same for the case of the thick recording sheet and the case of the thin recording sheet. More specifically, the separation action β starts at a point of 40 ms prior to time zero in which the rear end of the recording sheet P exits the secondary transfer nip. At the point in which the rear end of the recording sheet P exits the secondary transfer nip, the space X is slightly generated between the secondary transfer roller 24 and the intermediate transfer belt 10 to suppress load change. However, in some embodiments, when the recording sheet P is a thick recording sheet, the start timing of the separation action β is placed slightly earlier compared to when the recording sheet P is a thin recording sheet. By placing the start timing of the separation action β slightly earlier, a larger space X is provided at the point in which the rear end of the recording sheet P exits compared to the space X when the recording sheet P is a thin recording sheet.

The thickness of the recording sheet P, the start timing of the contact action α, and the value of the space X between the secondary transfer roller 24 and the secondary transfer opposing roller 16 at the point in which the front end of the recording sheet P enters the secondary transfer nip are not limited to the examples shown in FIG. 6 and FIG. 7.

The contact-separation controller 160 shown in FIG. 2 acquires recording sheet thickness information of the recording sheet P from the main controller with integrated control of at least the printing section 100 of the image forming apparatus shown in FIG. 1. In addition, when starting image formation, the main controller generates a trigger signal that is the reference for an action sequence of image formation. A timing of the action of each member is determined by a time management in which a clock signal is counted with the trigger signal as a reference. Therefore, a timing in which the front end of the recording sheet P enters the secondary transfer member and a timing in which the rear end of the recording sheet P exits the secondary transfer member can be determined or calculated. Accordingly, the contact-separation controller 160 also acquires timing information of the timing in which the front end of the recording sheet P enters the secondary transfer member and the timing in which the rear end of the recording sheet P exits the secondary transfer member.

For example, by acquiring a timing signal of the start of the rotation for conveying the recording sheet P to the secondary transfer nip by the pair of timing rollers 49 shown in FIG. 1 from the main controller, the contact-separation controller 160 can calculate the point of entry of the front end of the recording sheet P to the secondary transfer nip.

The contact-separation controller 160 shown in FIG. 2 determines the start timing of the contact action α based upon the recording sheet thickness information and the timing information acquired from the main controller. At the determined start timing of the contact action α, the cam driving motor 120 is driven and the first eccentric cam 110 and the second eccentric cam 111 are rotated in a clockwise or counter clockwise direction.

The start timing of the contact action α is determined so that a value obtained by subtracting the thickness of the recording sheet P from the space X in the second transfer nip between the secondary transfer roller 24 and the intermediate transfer belt 10 at the point of entry of the front end of the recording sheet P into the second transfer nip be approximately constant irrespective of the thickness of the recording sheet P.

Alternatively, individual data with respect to each thickness of the recording sheet P stored in advance in a memory of the contact-separation controller 160 can be used to determine a value of the start timing of the contact action α as well. When passing through a recording sheet P with a thickness not stored in the memory, the start timing of the contact action α can be determined by using data in accordance with a general type categorization of the thickness of the recording sheets.

As described above, the contact-separation controller 160 can obtain the timing with which the signal from the light receiving element 104*b* of the optical sensor 104 is interrupted when the contact-separation controller 160 rotates the first eccentric cam 110 and the second eccentric cam 111 by driving the cam driving motor 120. Based upon the rotation amount of the cam driving motor 120 from the timing the signal is interrupted, the contact-separation controller 160 can obtain the rotation angle of the first eccentric cam 110 and the second eccentric cam 111.

If a normal recording sheet or a thin recording sheet is used as the recording sheet P and the start timing of the contact action α is the same as when using a thick recording sheet, the value obtained by subtracting the thickness of the recording sheet P from the space X between the secondary transfer roller 24 and the intermediate transfer belt 10 at the point of entry of the front end of the recording sheet P to the secondary transfer nip is larger compared to a case using the thick recording sheet. As a result, image failure may be generated due to return shock. Therefore, it is preferable that the start timing of the contact action α is set earlier than when using a thick recording sheet.

When the contact-separation controller 160 shown in FIG. 2 rotates the first eccentric cam 110 and the second eccentric cam 111 serving as cam members to the second position as shown in FIG. 4 from the first position as shown in FIG. 3, and from the second position to the first position shown in FIG. 5, the contact-separation controller 160 is rotated in the same direction, thus simplifying the control of rotation.

In some embodiments, when rotating the first eccentric cam 110 and the second eccentric cam 111 from the first position to the second position, and the second position to the first position, the contact-separation controller 160 is reciprocally moved back and forth.

By reciprocally rotating the cam members back and forth, a large rotation angle can be used for each contact action and each separation action of cam members. The use of the large rotation angle achieves a reduction in contact and separation torque.

In the above-described embodiment, when the intermediate transfer belt 10 revolves, the secondary transfer roller 24 is rotationally driven at a speed in which the outer circumference speed of the secondary transfer roller 24 is approximately the same as the moving speed of the surface of the outer circumference of the intermediate transfer belt 10. As a result, the recording sheet P in the secondary transfer nip is reliably conveyed at a constant speed, and secondary transfer of the toner image is enabled.

In some embodiments, the secondary transfer roller 24 rotationally driven at a speed in which the outer circumference speed is approximately the same as the moving speed of the surface of the outer circumference of the intermediate transfer belt 10 is freely rotatable at periods other than when the front end of the recording sheet P enters the secondary transfer nip and the rear end of the recording sheet P exits the secondary transfer nip.

As a result, a fluctuation of the moving speed due to a sharp increase or a sharp decrease in load upon the entry of the recording sheet P to the secondary transfer nip and the exit of the recording sheet P from the secondary transfer nip can be substantially reduced. During secondary transfer, the secondary transfer roller 24 is rotated with the movement of the intermediate transfer belt 10. There is no risk of an occurrence of speed difference between the surface of the secondary transfer roller 24 and the surface of the intermediate transfer belt 10, and thus there is almost no generation of transfer blurring. Accordingly, a high quality image can be formed.

In view of the foregoing, an image forming apparatus according to at least one embodiments of the present invention changes the start timing of the contact action $\alpha$ according to the thickness of the recording medium. The start timing of the contact action $\alpha$ is the start of a transition in which the secondary transfer roller 24 and the intermediate transfer belt 10 forming the secondary transfer nip changes from being in a separated state to a contacting state by rotating the cam members when the recording medium enters the secondary transfer nip. As a result, the space X in the secondary transfer nip when the recording medium enters the secondary transfer nip can be optimized according to the thickness of the recording medium, and the generation of load change and vibration due to impact or return shock does not occur irrespective of the thickness of the recording medium. Accordingly, consistent good transfer of an image is realized.

[Regarding the Image Forming Apparatus and the Recording Medium]

An example of an embodiment of the present invention has been described above though the present invention is not limited to the image forming apparatus shown in FIG. 1. The present invention is applicable to any image forming apparatus including a mechanism that can implement the action of the secondary transfer part of the present invention, such as a color printer, a color facsimile machine, or a multi-functional system including at least one of the functions thereof.

Similarly, an image forming section forming the toner image on the image carrier may be a type in which the toner image of each color is sequentially formed on a single photoreceptor drum or a photoreceptor belt serving as the image carrier. In addition, the present invention is applicable to an image forming apparatus using an intermediate transfer drum in place of the intermediate transfer belt as the intermediate transfer member. In such a configuration, the secondary transfer nip is formed between the intermediate transfer drum and the secondary transfer roller, and the secondary transfer opposing roller is not needed.

The present invention is also applicable to an image forming apparatus using a secondary transfer belt in place of the secondary transfer roller serving as the secondary transfer member.

In the above examples, the recording medium is described as the recording sheet P. The recording medium is also referred to as a recording material, a transfer sheet, a cut paper, a normal paper, a transfer paper, paper, a resin sheet, leather, or cloth. The recording medium to which the toner image is transferred can be any medium with a sheet shape.

Furthermore, it is to be understood that elements and/or features of different illustrative embodiments may be combined with each other and/or substituted for each other within the scope of this disclosure and appended claims. In addition, the number of constituent elements, locations, shapes, and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image forming unit to form a toner image on an image carrier;

an intermediate transfer member to which the toner image formed on the image carrier is transferred in a primary transfer;

a secondary transfer member to form a secondary transfer nip with the intermediate transfer member and the secondary transfer member and transfer the toner image on the intermediate transfer member to a recording medium when the recording medium passes through the secondary transfer nip in a secondary transfer;

a biasing mechanism to bias the secondary transfer member toward the intermediate transfer member;

a cam member that is rotatable between a first position, at which the secondary transfer member is separated from the intermediate transfer member to form a predetermined space in the secondary transfer nip, and a second position, at which the secondary transfer member and the intermediate transfer member contact each other; and a contact-separation controller configured to:

put the cam member in the first position to form the predetermined space in the secondary transfer nip before entry of the recording medium into the secondary transfer nip;

rotate the cam member toward the second position when the recording medium enters the secondary transfer nip; and change a start timing of rotation of the cam member in accordance with a thickness of the recording medium, the contact-separation controller is configured to rotate the cam member from the first position to the second position when a front end of the recording medium approaches the secondary nip based on a thickness of the recording medium and configured to rotate the cam member from the second position to the first position when a rear end of the recording medium is exiting the secondary transfer nip, without regard for the thickness of the recording medium, and form the space in the secondary transfer nip at a point in which the rear end of the recording medium exits the secondary transfer nip.

2. The image forming apparatus of claim 1, wherein the contact-separation controller is configured to adjust the start timing of rotation of the cam member so that a value obtained by subtracting the thickness of the recording medium from a distance of the predetermined space in the secondary transfer nip at a point of entry of a front end of the recording medium be approximately constant irrespective of the thickness of the recording medium.

3. The image forming apparatus of claim 1, wherein the contact-separation controller is configured to rotate the cam member from the first position to the second position and from the second position to the first position in same direction.

4. The image forming apparatus of claim 1, wherein the contact-separation controller is configured to rotate the cam member reciprocally back and forth between the first position and the second position.

5. The image forming apparatus of claim 1, wherein the intermediate transfer member is an intermediate transfer belt and includes a secondary transfer opposing roller provided opposite the secondary transfer member to support the intermediate transfer belt from a back face of the intermediate transfer belt, and the cam member is configured to increase a distance between shafts of the secondary transfer member and the secondary transfer opposing roller when the cam member is rotated to the first position and reduce the distance between the shafts of the secondary transfer member and the secondary transfer opposing roller when the cam member is rotated to the second position.

6. The image forming apparatus of claim 1, wherein the secondary transfer member is configured to be rotationally driven at a speed in which an outer circumference speed of the secondary transfer member is approximately same as a moving speed of a surface of an outer circumference of the intermediate transfer member.

7. The image forming apparatus of claim 1, wherein the secondary transfer member is configured to be rotationally driven at a speed at which an outer circumference speed of the secondary transfer member is approximately same as a moving speed of a surface of an outer circumference of the intermediate transfer member only at periods in which a front end of the recording medium enters the secondary transfer nip and a rear end of the recording medium exits the secondary transfer nip, and at other periods the secondary transfer member is freely rotatable.

8. The image forming apparatus of claim 1, wherein the thickness of the recording medium is acquired by the contact-separation controller from a main controller of the image forming apparatus.

9. The image forming apparatus of claim 1, wherein the start timing of rotation of the cam from the first position to the second position when the front end of the recording medium approaches the secondary nip is set earlier as the thickness of the recording medium decreases.

* * * * *